US007785214B2

(12) United States Patent
Horacek et al.

(10) Patent No.: US 7,785,214 B2
(45) Date of Patent: Aug. 31, 2010

(54) GOLF CLUB HEAD

(75) Inventors: Robert J. Horacek, Hermosa Beach, CA (US); Nathaniel J. Radcliffe, Huntington Beach, CA (US); John J. Rae, Westminster, CA (US)

(73) Assignee: SRI Sports Limited, Kobe-Shi (JP)

( * ) Notice: Subject to any disclaimer, the term of this patent is extended or adjusted under 35 U.S.C. 154(b) by 55 days.

(21) Appl. No.: 12/324,508

(22) Filed: Nov. 26, 2008

(65) Prior Publication Data

US 2009/0075754 A1 Mar. 19, 2009

(51) Int. Cl.
*A63B 53/04* (2006.01)

(52) U.S. Cl. ..... 473/345

(58) Field of Classification Search ..... 473/324–350
See application file for complete search history.

(56) References Cited

U.S. PATENT DOCUMENTS

| | | | |
|---|---|---|---|
| RE19,178 | E | 5/1934 | Spiker |
| 3,085,804 | A | 4/1963 | Pieper |
| 3,166,320 | A | 1/1965 | Onions |
| 3,893,672 | A | 7/1975 | Schonher |
| 4,077,633 | A | 3/1978 | Studen |
| 4,147,349 | A | 4/1979 | Jeghers |
| 4,165,076 | A | 8/1979 | Cella |
| 4,247,105 | A | 1/1981 | Jeghers |
| 4,527,799 | A | 7/1985 | Solheim |
| 4,592,552 | A | 6/1986 | Garber |
| 4,787,636 | A | 11/1988 | Honma |
| 4,881,739 | A | 11/1989 | Garcia |
| 4,895,367 | A | 1/1990 | Kajita et al. |
| 4,919,428 | A | 4/1990 | Perkins |
| 5,116,054 | A | 5/1992 | Johnson |
| 5,255,919 | A | 10/1993 | Johnson |
| 5,301,944 | A | 4/1994 | Koehler |
| 5,340,106 | A | 8/1994 | Ravaris |
| 5,482,280 | A | 1/1996 | Yamawaki |
| 5,558,332 | A | 9/1996 | Cook |
| 5,695,412 | A | 12/1997 | Cook |
| 5,759,114 | A | 6/1998 | Bluto et al. |
| 5,785,608 | A | 7/1998 | Collins |
| 5,885,166 | A | 3/1999 | Shiraishi |
| 5,890,971 | A | 4/1999 | Shiraishi |
| 6,033,319 | A | 3/2000 | Farrar |
| 6,083,115 | A | 7/2000 | King |

(Continued)

FOREIGN PATENT DOCUMENTS

| | | |
|---|---|---|
| JP | A-09-299520 | 11/1997 |

(Continued)

*Primary Examiner*—Alvin A Hunter
(74) *Attorney, Agent, or Firm*—Oliff & Berridge, PLC

(57) ABSTRACT

A golf club head according to one or more aspects of the present invention may include a heel, a toe, a crown, a sole, a strike face, and a lower transition region between the strike face and the sole. The lower transition region may have a plurality of nadir angles progressively increasing in size from the central region of the strike face to the heel and/or toe. The club head may further include an upper transition region between the strike face and the crown. The upper transition region may have a plurality of apex angles progressively increasing in size from the central region of the strike face to the heel and/or toe.

9 Claims, 24 Drawing Sheets

U.S. PATENT DOCUMENTS

| | | | | |
|---|---|---|---|---|
| 6,093,113 | A | 7/2000 | Mertens | |
| 6,464,598 | B1 | 10/2002 | Miller | |
| 6,716,114 | B2 * | 4/2004 | Nishio | 473/314 |
| 6,723,002 | B1 | 4/2004 | Barlow | |
| 6,860,823 | B2 | 3/2005 | Lee | |
| 7,004,849 | B2 | 2/2006 | Cameron | |
| D518,123 | S | 3/2006 | Jones et al. | |
| D522,597 | S | 6/2006 | Sanchez | |
| 7,169,058 | B1 | 1/2007 | Fagan | |
| 7,294,064 | B2 | 11/2007 | Tsurumaki et al. | |
| 2002/0183130 | A1 | 12/2002 | Pacinella | |
| 2004/0192463 | A1 | 9/2004 | Tsurumaki et al. | |
| 2006/0009305 | A1 | 1/2006 | Lindsay | |
| 2006/0094535 | A1 | 5/2006 | Cameron | |
| 2006/0281581 | A1 | 12/2006 | Yamamoto | |
| 2007/0275792 | A1 | 11/2007 | Horacek et al. | |

FOREIGN PATENT DOCUMENTS

| | | |
|---|---|---|
| JP | A-2000-140165 | 5/2000 |
| JP | U-3076282 | 12/2000 |
| JP | S-1127697 | 12/2001 |
| JP | S-1128564 | 12/2001 |
| JP | A-2002-102394 | 4/2002 |
| JP | A-2002-143350 | 5/2002 |
| JP | A-2002-306648 | 10/2002 |
| JP | A-2003-180885 | 7/2003 |
| JP | A-2003-210627 | 7/2003 |
| JP | A-2004-000673 | 1/2004 |
| JP | A-2004-147756 | 5/2004 |
| JP | A-2004-305522 | 11/2004 |
| JP | A-2004-313762 | 11/2004 |
| JP | A-2004-351054 | 12/2004 |
| JP | A-2006-345911 | 12/2006 |
| JP | A-2007-097848 | 4/2007 |

* cited by examiner

GOLF CLUB HEAD

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

It is generally known to those skilled in the art that maximum energy transfer at impact between a wood-type golf club head and a golf ball occurs proximate the face center of the head, whereas on off-center hits, energy transfer at ball impact declines, in part due to a reduction in face compliance in the peripheral regions of the strike face, causing a loss in accuracy, ball speed, and carry distance. While this phenomenon is usually not a concern for experienced golfers, whose skill level is ordinarily synonymous with well-struck shots, it may have a negative impact on average-to-low skill players, causing them to lose confidence in the equipment.

SUMMARY

The present invention, in one or more aspects thereof, may comprise a golf club head that promotes enhanced overall face compliance, augmented forgiveness on off-center shots, improved launch conditions, greater carry distance, increased durability, and elevated player confidence.

In one example, a golf club head according to one or more aspects of the present invention may include a lower transition region comprising a center anterior nadir and a center posterior nadir located in an imaginary vertical center plane. A center nadir angle may be formed between a ground plane and an imaginary center nadir line that passes through the center anterior and posterior nadirs. The lower transition region may further include an offset anterior nadir and an offset posterior nadir located in an imaginary vertical offset plane. An offset nadir angle may be formed between the ground plane and an offset nadir line that passes through the anterior and posterior nadirs. The club head, according to one or more aspects of the present invention, is configured so that the offset nadir angle is greater than the center nadir angle.

In another example, a golf club head according to one or more aspects of the present invention may include a lower transition region and a strike face having a face center and a sweet spot. The lower transition region may have a center anterior nadir disposed in an imaginary vertical center plane at least about 7 mm above a ground plane. The sweet spot is located below an imaginary horizontal plane that passes through the strike face 2 mm above the face center.

In yet another example, a golf club head according to one or more aspects of the present invention may include an upper transition region comprising a center anterior apex and a center posterior apex, located in an imaginary vertical center plane. A center apex angle may be formed between a ground plane and an imaginary center apex line that passes through the center anterior and posterior apexes. The upper transition region may further include an offset anterior apex and an offset posterior apex located in an imaginary vertical offset plane. An offset apex angle may be formed between the ground plane and an offset apex line that passes through the offset anterior and posterior apexes. The club head, according to one or more aspects of the present invention, is configured so that the offset apex angle is greater than the center apex angle.

In yet another example, a golf club head according to one or more aspects of the present invention may include a center anterior nadir and a center anterior apex. The center anterior nadir may be located in an imaginary vertical center plane and may have a height relative to a ground plane. The center anterior apex may be located in the imaginary vertical center plane and may have an elevation relative to the center anterior nadir. Preferably, the ratio of the center anterior nadir height to the center anterior apex elevation is at least about 0.12.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein:

FIG. 1O is a front elevational view of the golf club head of FIG. 1.

DESCRIPTION

Figure 1:
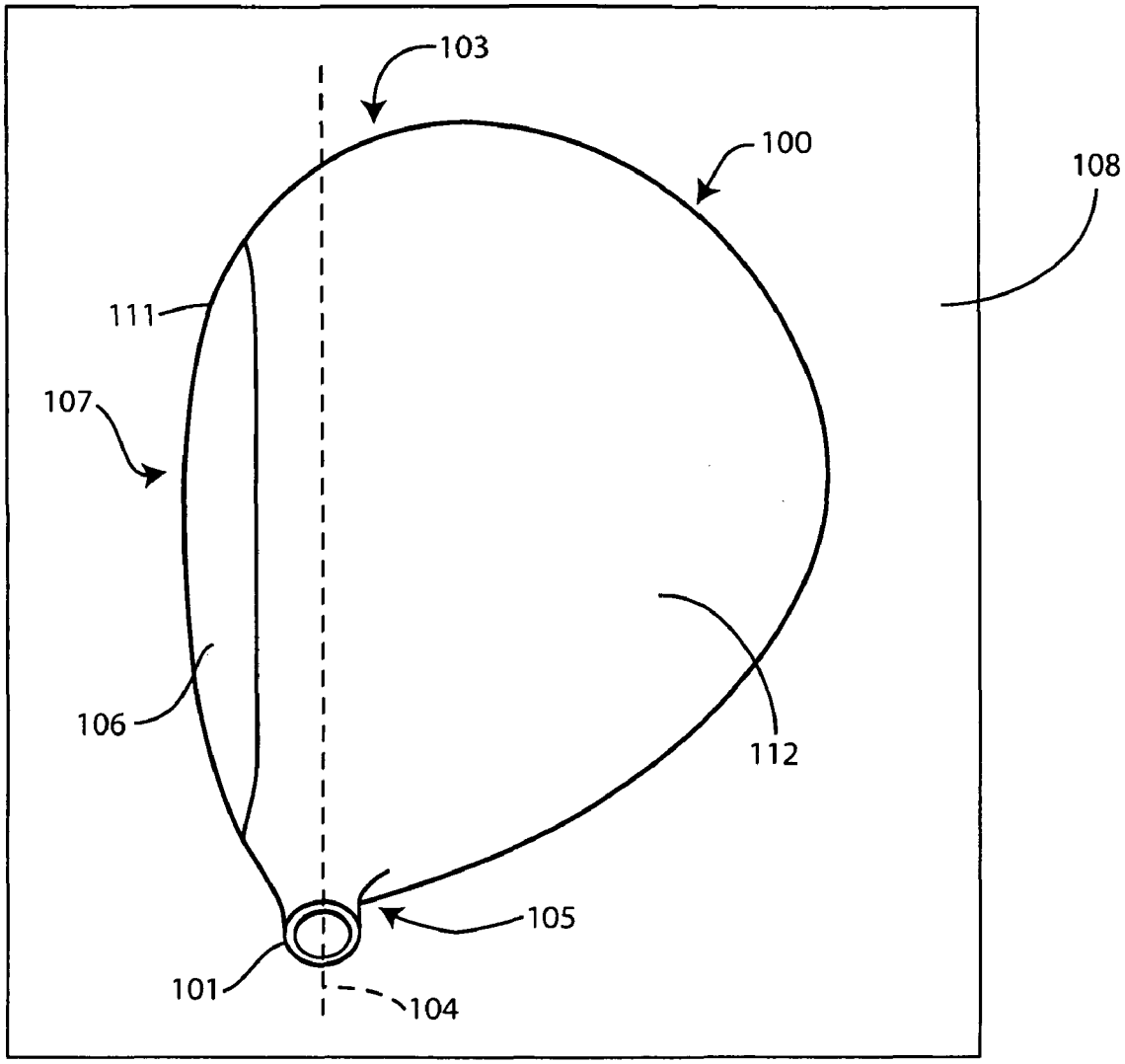
FIG. 1 is a top plan view of an exemplary golf club head according to one or more aspects of the present invention.
Figure 1A:
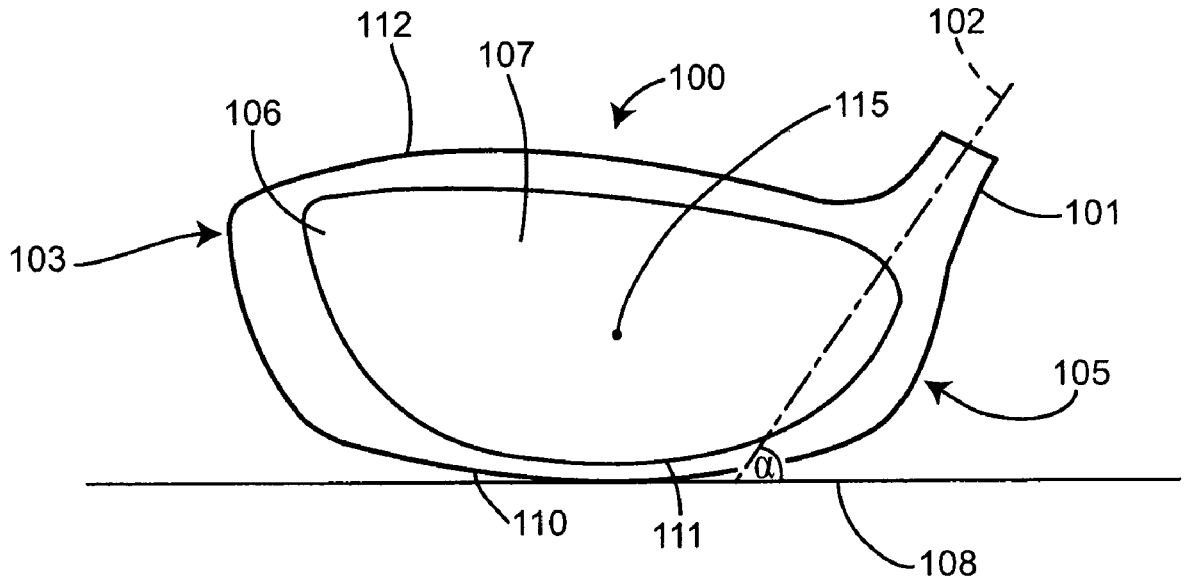
FIG. 1A is a front elevational view of the golf club head of FIG. 1.

Referring to FIGS. 1 and 1A, a club head 100 may comprise a toe 103, a heel 105, a hosel 101, having a central axis (centerline) 102, a sole portion 110, a crown portion 112, and a front surface 107, including a strike face 106. The strike face 106 may have a leading edge 111.

Referring again to FIGS. 1 and 1A, "reference position," as used herein, denotes a position of the club head 100 where the hosel centerline 102 (FIG. 1A) is in an imaginary vertical hosel plane 104 (FIG. 1) and is oriented at a lie angle $\alpha$ of substantially 60° with respect to a ground plane 108. The plane 104 is oriented substantially parallel to the leading edge 111. Unless otherwise indicated, all parameters below are specified with the club head in the reference position.

Figure 1B:
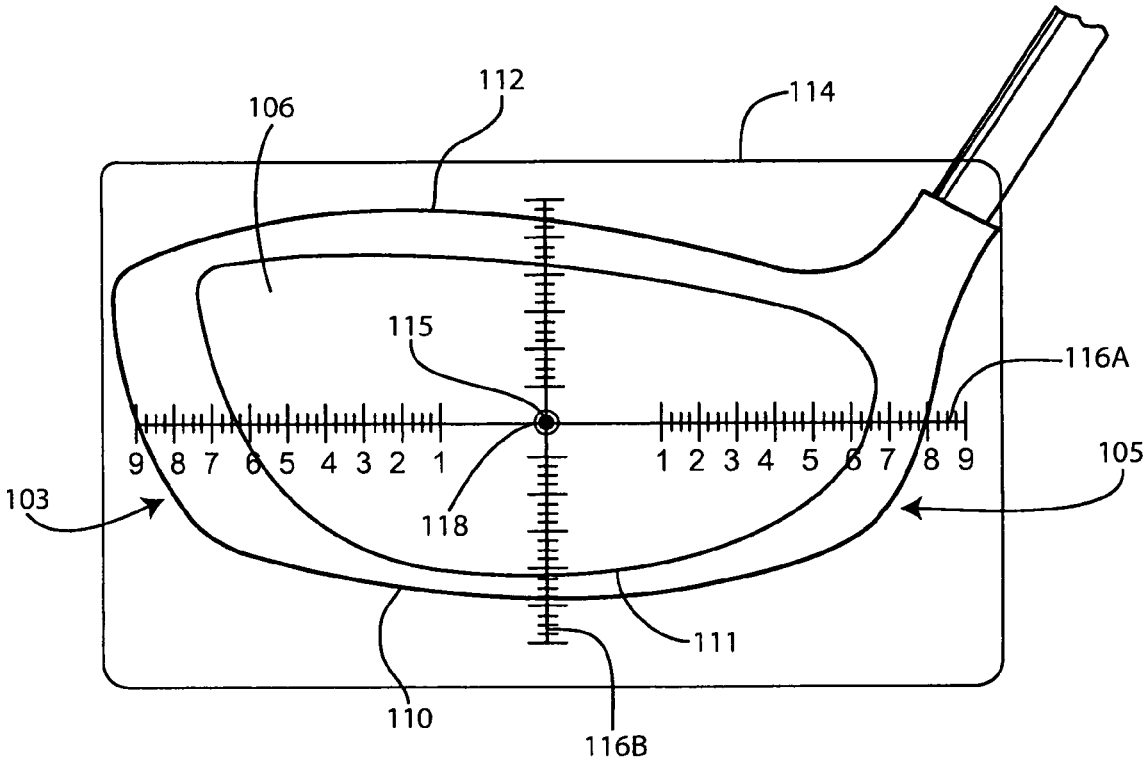
FIG. 1B is a front elevational view of the golf club head of FIG. 1, with a face-center locating template applied thereto.

Referring to FIGS. 1A and 1B, "face center", e.g., a face center 115, as used herein, is located using a template 114, having a coordinate system with a heel-toe axis 116*a* orthogonal to a sole-crown axis 116*b*. An aperture 118 is disposed at the origin of the coordinate system and the axes are graduated with evenly spaced increments. The template 114 may be made of a flexible material, e.g., a transparent polymer.

The location of the face center 115 is determined as follows. The template 114 is initially applied to the strike face 106 so that the aperture 118 is generally in the middle of the strike face and the heel-toe axis 116*a* is substantially parallel to the leading edge 111. The template is then translated back and forth in the heel-toe direction along the strike face 106 until the heel and toe measurements at the opposite edges of the strike face have the same absolute value. Once the template 114 is centered on the strike face 106 in the heel-toe direction, it is translated back and forth in the sole-crown direction along the strike face until the sole and the crown measurements at the opposite edges of the strike face have the same absolute value. The above sequence is repeated until the heel and the toe measurements, as well as the sole and the crown measurements, are equal and opposite along the corresponding axes. A point is then marked on the striking surface via the aperture 118 to designate the face center 115.

A locating template, such as the template 114, is referenced in the United States Golf Association's Procedure for Measuring the Flexibility of a Golf Clubhead (Revision 2.0, Mar. 25, 2005) and is available from the USGA.

Figure 1C:
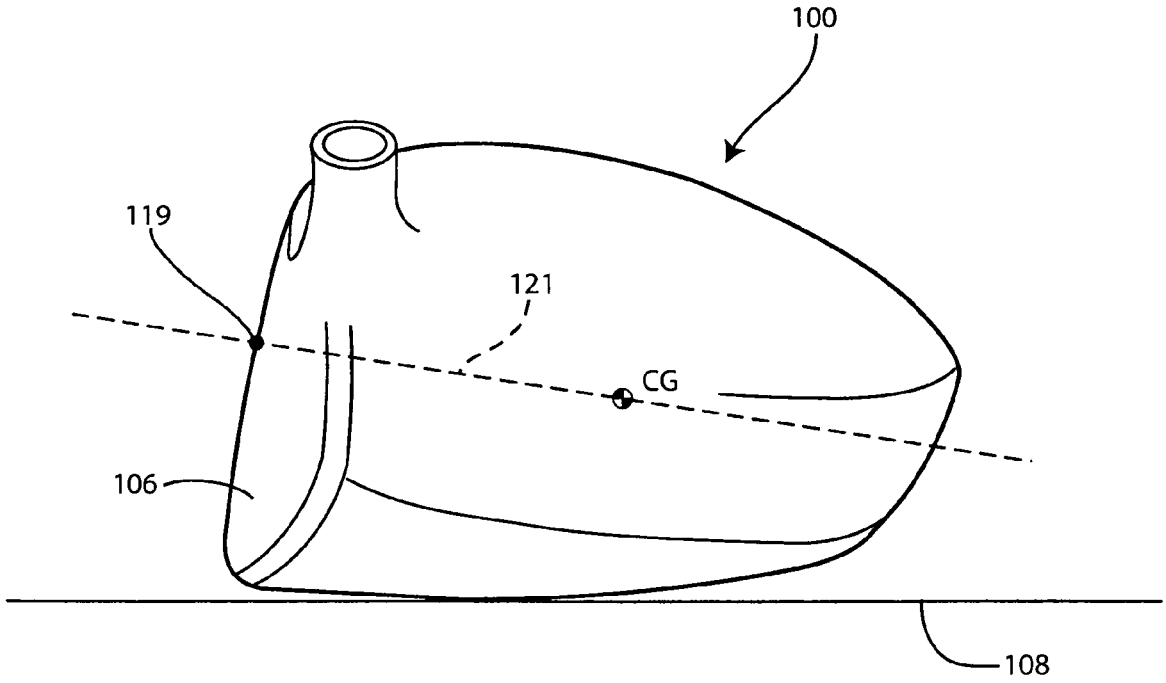
FIG. 1C is a heel-side elevational view of the golf club head of FIG. 1.

Referring to FIG. 1C, "sweet spot", e.g., a sweet spot 119, as used herein, refers to the point of intersection between the strike face 106 and an imaginary line 121 that is substantially perpendicular to the strike face 106 and passes through the center of gravity CG of the club head 100.

"Discretionary mass", as used herein, refers to the difference between the target mass of the club head and the minimum structural mass required to form the head.

Figure 1D:
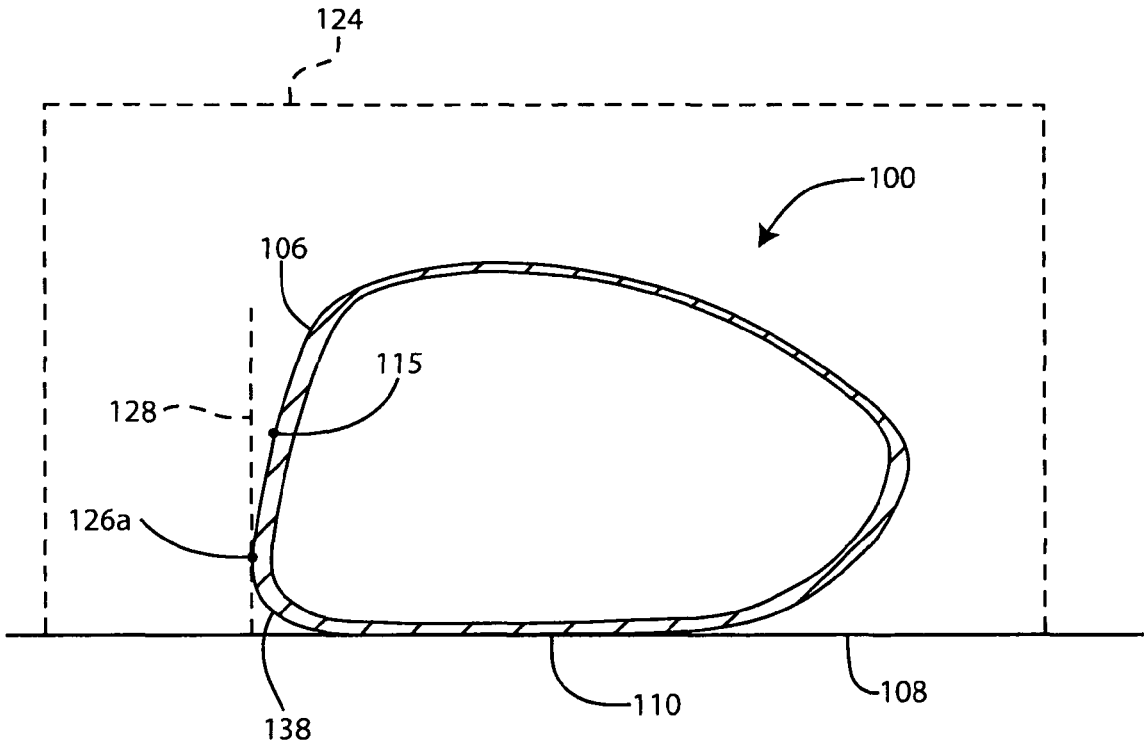
FIG. 1D is a heel-side cross-sectional view of the golf club head of FIG. 1.

Referring to FIG. 1D, the club head 100, according to one or more aspects of the present invention, may further comprise a lower transition region 138 between the strike face 106 and the sole portion 110. The presence of the lower transition region 138 increases the average compliance of the strike face 106 During a golf shot, the increased face compliance improves energy transfer from the club head 100 to a golf ball, thus increasing the initial ball velocity and ball travel distance.

Figure 1E:
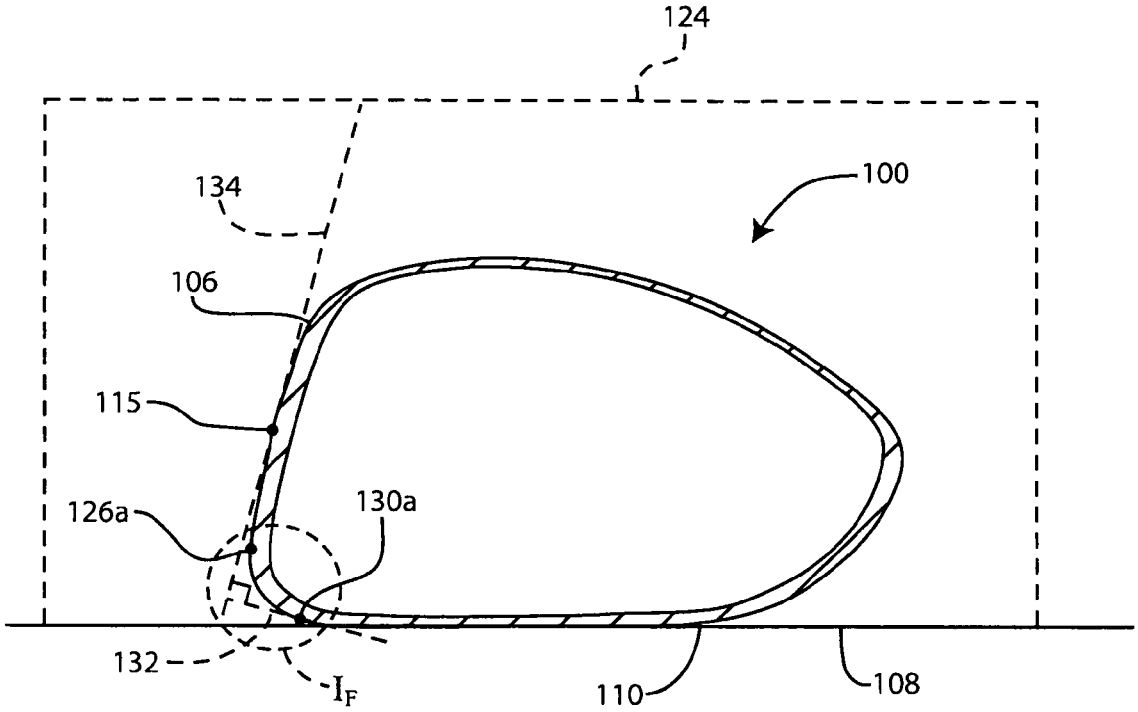
FIG. 1E is a heel-side cross-sectional view of the golf club head of FIG. 1.

Referring again to FIG. 1D, the lower transition region 138 may include an center anterior nadir 126*a*, characterized by the intersection of the leading edge of the club head with an imaginary vertical line 128, located in an imaginary vertical center plane 124 that is substantially perpendicular to the hosel plane 104 (FIG. 1) and passes through the face center 115. As shown in FIG. 1E, the head may also include a center posterior nadir 130*a*, characterized by the point of tangency between the sole portion 110 of the club head and an imaginary line 132, located in the center plane 124 and perpendicular to a plane 134 that is tangent to the strike face 106 at the face center 115.

Figure 1F:
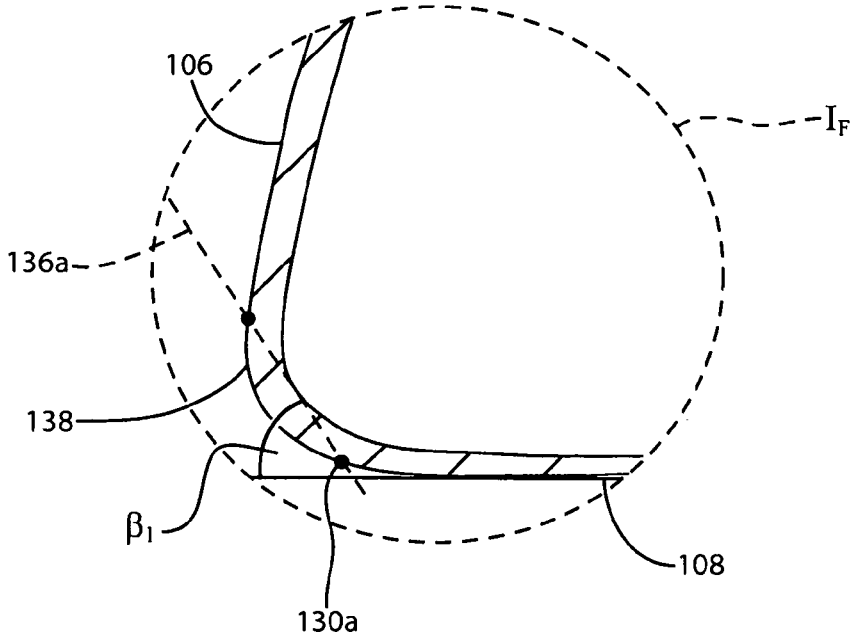
FIG. 1F is an enlarged cross-sectional view of a detail $I_F$ of FIG. 1E.

Referring to FIGS. 1E and 1F, a center nadir angle $\beta_1$ may be formed between the ground plane 108 and an imaginary center nadir line 136*a*, passing through the center anterior nadir 126*a* and the center posterior nadir 130*a*. Compliance of the strike face 106 may be modified by increasing or decreasing the center nadir angle $\beta_1$. For example, as the center nadir angle $\beta_1$ increases, the face compliance of the strike face 106 is also increased.

Figure 1G:
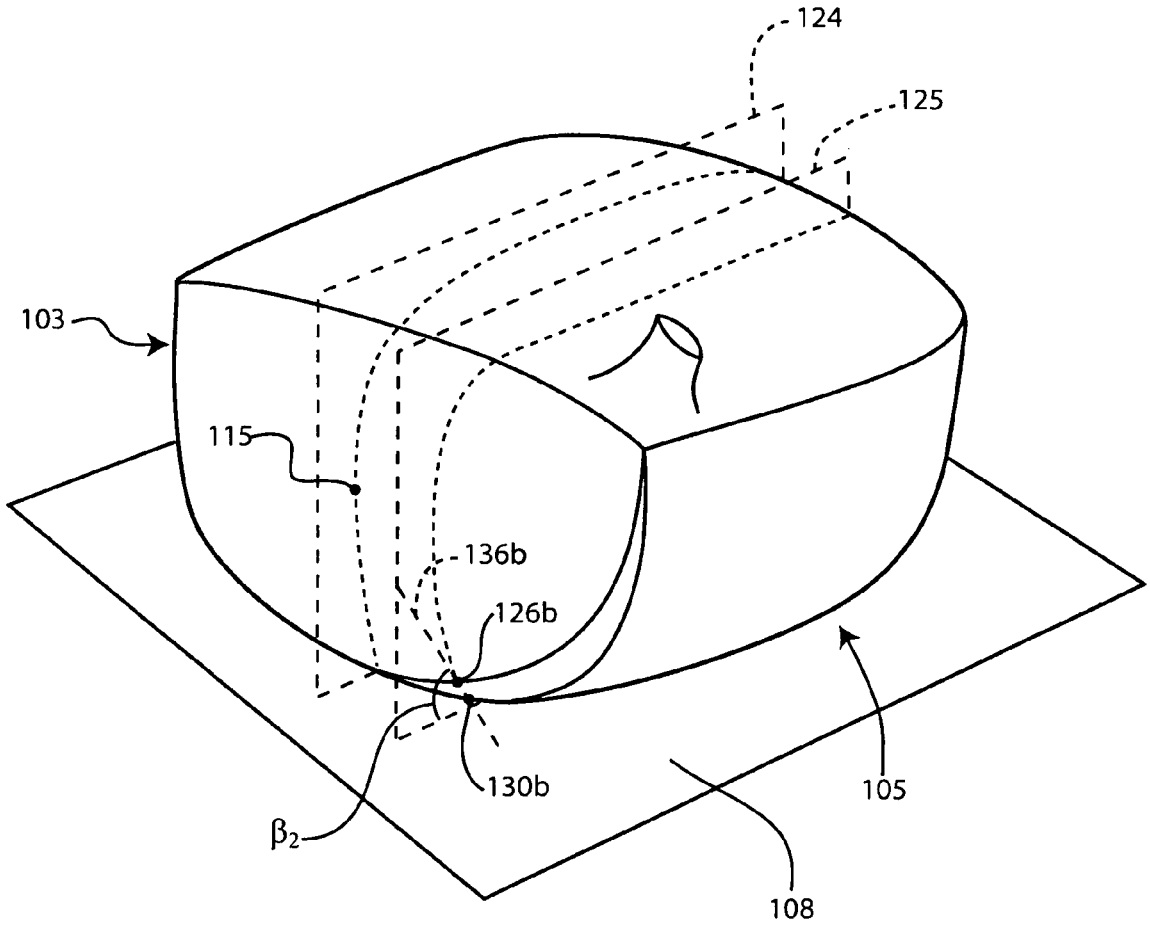
FIG. 1G is a front perspective view of the golf club head of FIG. 1.

As shown in FIG. 1G, offset nadir angles, e.g., an offset nadir angle $\beta_2$, are located in corresponding imaginary vertical offset planes, e.g., an offset plane 125, parallel to the center plane 124 and intersecting the club head 100. Each offset nadir angle is formed between the ground plane 108 and an imaginary offset nadir line, e.g., an imaginary offset nadir line 136*b*, passing through an offset anterior nadir, e.g., an offset anterior nadir 126*b*, and through a corresponding co-planar offset posterior nadir, e.g., an offset posterior nadir 130*b*. The offset anterior nadirs and the corresponding co-planar offset posterior nadirs are identified using the methodologies described above for locating the center anterior and posterior nadirs.

To minimize the variation in compliance, also known as the coefficient of restitution (COR), across the face of a club head in the heel-toe direction, numerical values of the club head's nadir angles progressively increase from the central region of the strike face 106 toward the toe 103 and/or the heel 105. For example, the numerical value of the center nadir angle $\beta_1$ (FIG. 1F) may be at least about 5° less than the value of the offset nadir angle $\beta_2$ (FIG. 1G), which is located in an imaginary vertical offset plane 125, spaced a horizontal distance of 20 mm from the center plane 124, parallel thereto. In other examples, the value of the center nadir angle $\beta_1$ may be at least about 8° less than the value of the offset nadir angle $\beta_2$ or, more preferably, at least 10° less than the value of the offset nadir angle $\beta_2$. The above-described head configuration helps maintain the maximum allowable USGA COR limit at the face center, while simultaneously improving face compliance toward the toe and/or the heel of the club head.

Figure 1H:
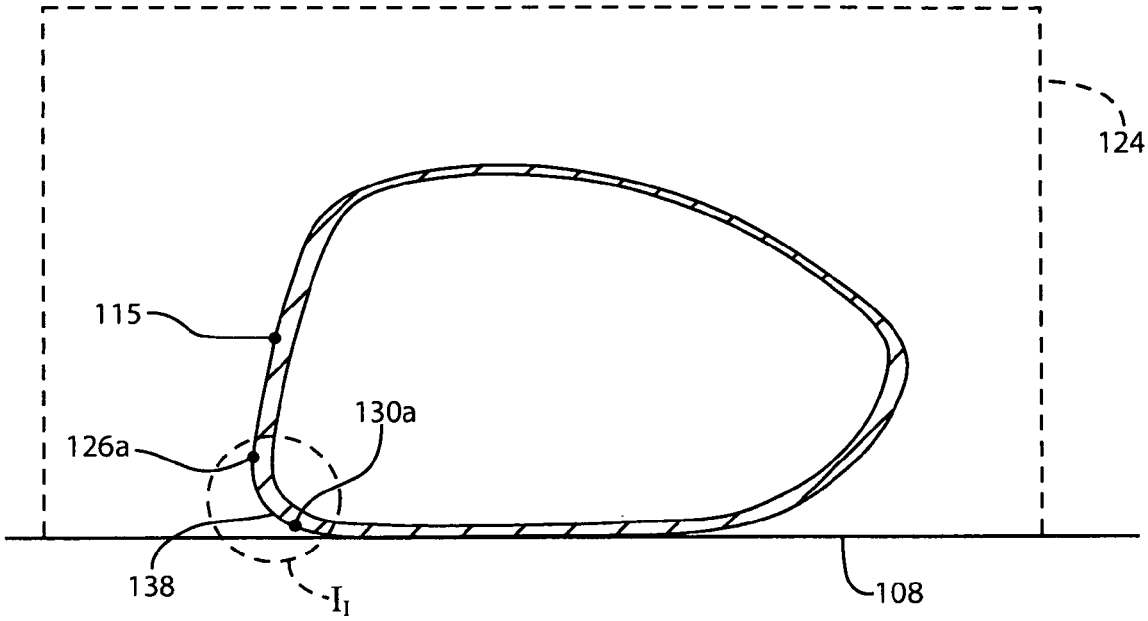
FIG. 1H is a heel-side cross-sectional view of the golf club head of FIG. 1.
Figure 1I:
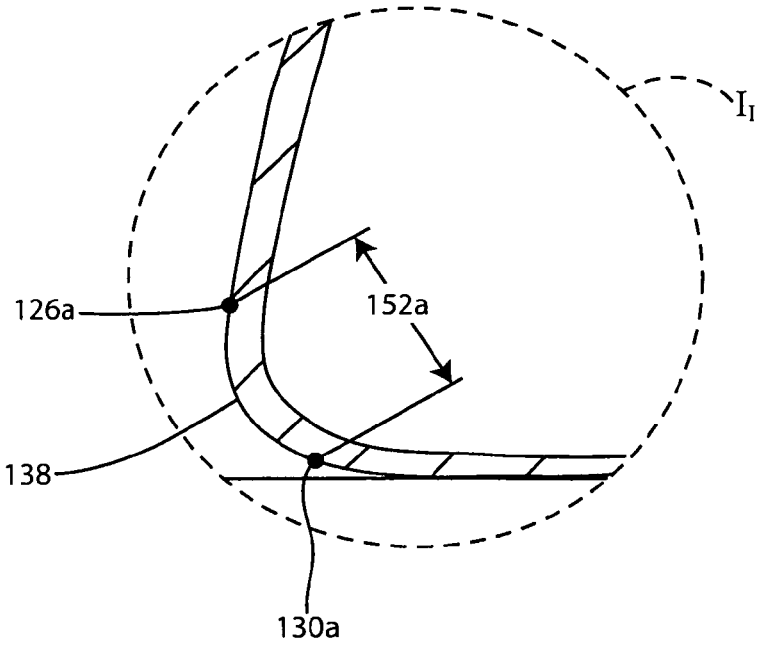
FIG. 1I is an enlarged cross-sectional view of a detail $I_I$ of FIG. 1H.

Referring to FIG. 1H and 1I, the lower transition region 138 may have an actual center nadir distance 152*a* in the center plane 124. The actual center nadir distance 152*a* is characterized as the shortest distance between the center anterior nadir 126*a* and the center posterior nadir 130*a*. The center nadir distance 152*a* may be varied to change the compliance of the strike face 106. Increasing the center nadir distance 152*a* may enhance face compliance, whereas decreasing the center nadir distance 152*a* may reduce face compliance. Preferably, the center nadir distance 152*a* may be at least about 8 mm, more preferably at least about 10 mm, and most preferably at least about 12 mm.

Figure 1J:
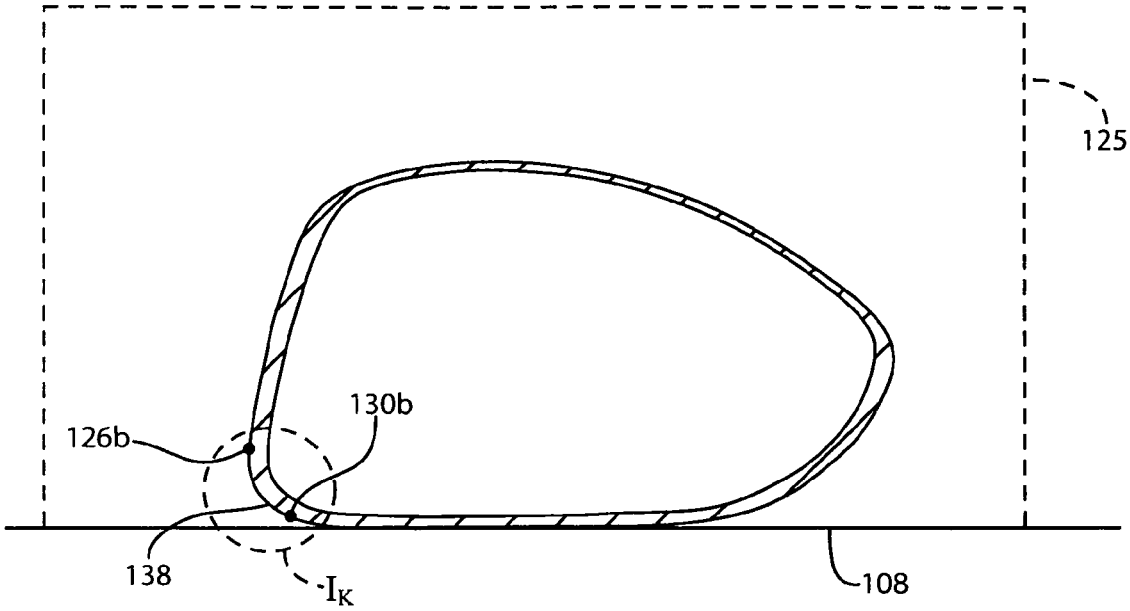
FIG. 1J is a heel-side cross-sectional view of the golf club head of FIG. 1.
Figure 1K:
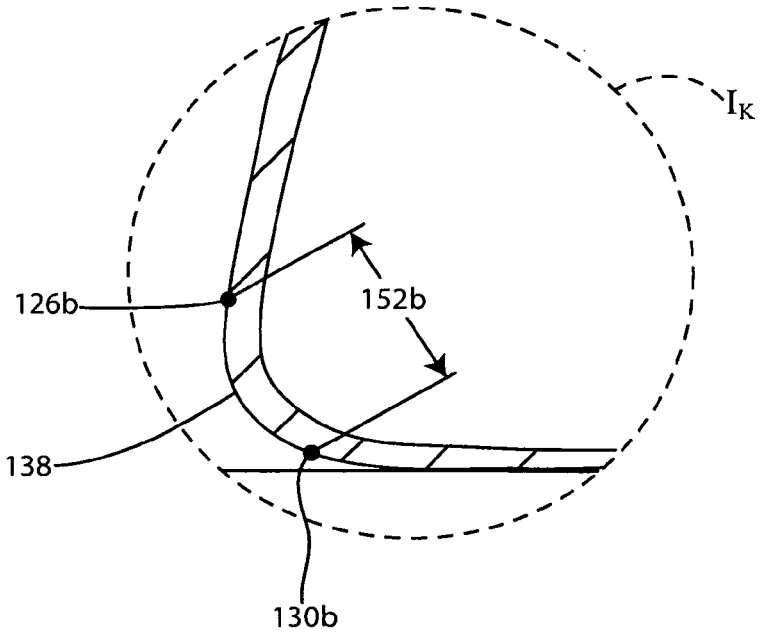
FIG. 1K is an enlarged cross-sectional view of a detail $I_K$ of FIG. 1J.

Referring to FIGS. 1J and 1K, an actual offset nadir distance 152*b* is characterized as the shortest distance between the offset anterior nadir and the corresponding co-planar offset posterior nadir. Preferably, the offset nadir distance is greater than the center nadir distance 152*a* (FIG. 1I) to help improve the compliance of the strike face 106 away from the face center. For example, the offset nadir distance 152*b* may be greater than the center nadir distance by at least about 2 mm. Preferably, the offset nadir distance 152*b* may be at least about 8 mm, more preferably at least about 10 mm, and most preferably at least about 12 mm.

Figure 1L:
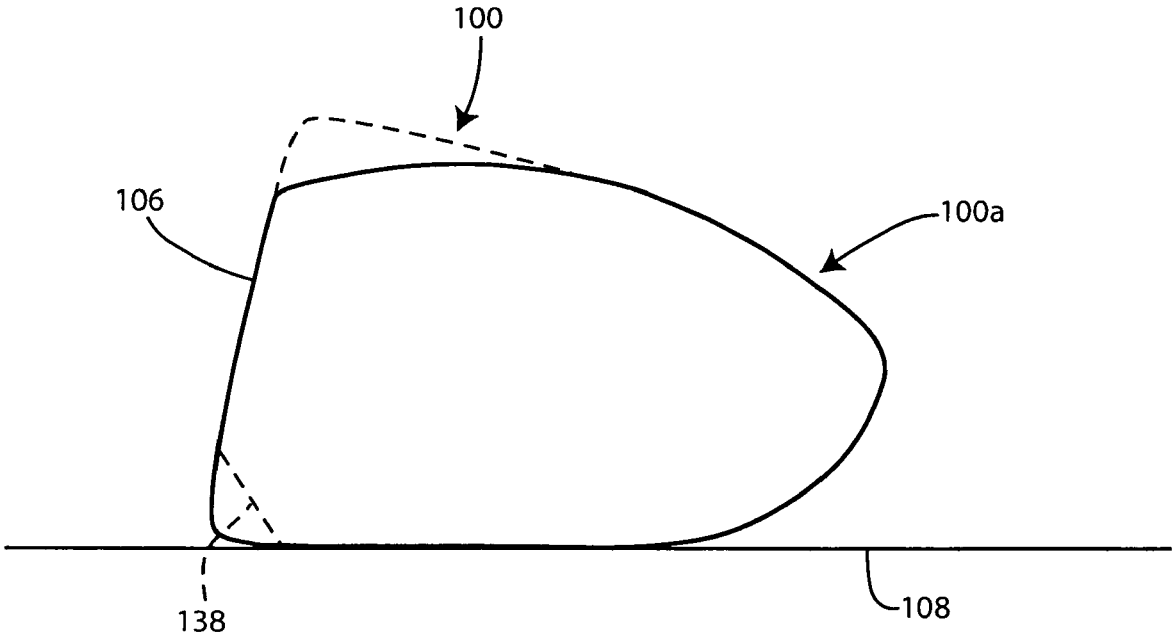
FIG. 1L is a heel-side schematic view of the golf club head of FIG. 1.
Figure 1M:
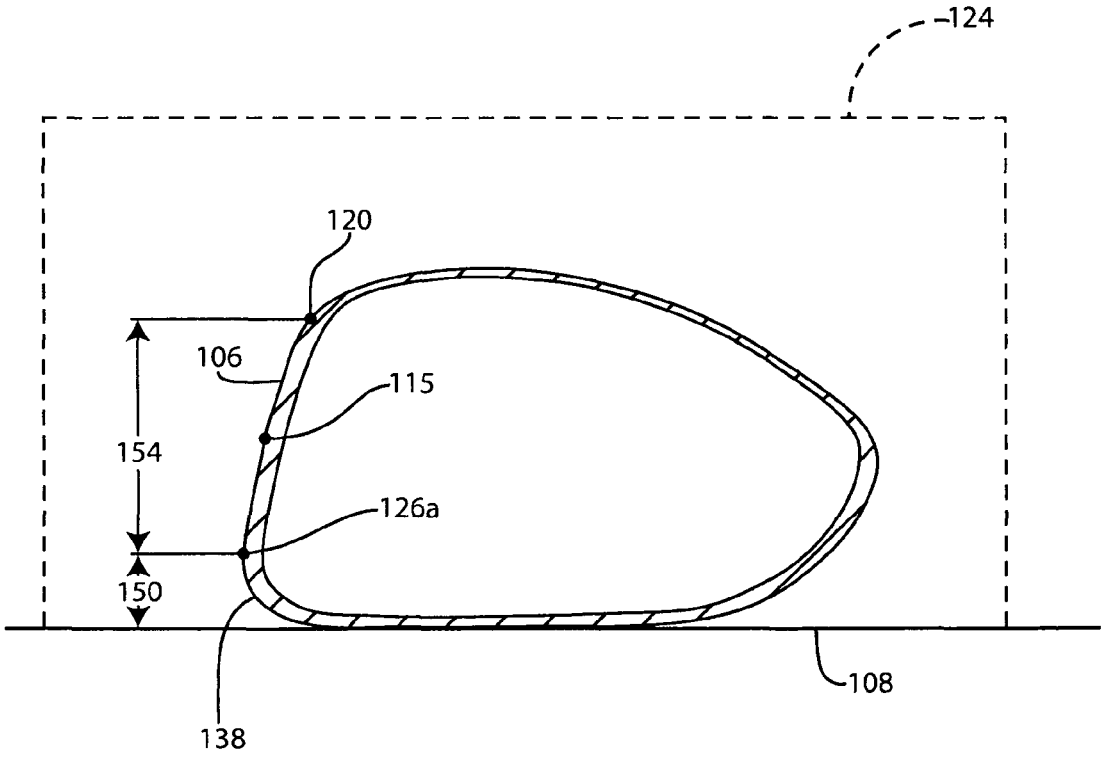
FIG. 1M is a heel-side cross-sectional view of the golf club head of FIG. 1.

Since the club head 100 incorporates the lower transition region 138, the strike face 106 of the club head is elevated relative to that of a conventional club head 100*a*, as illustrated in FIG. 1L. A club head whose face appears taller and, therefore, more forgiving at address fosters an improvement in player confidence, promoting increased swing speeds and associated longer ball carries. As shown in FIG. 1M, the center anterior nadir 126*a* may have a height 150 of at least about 6 mm, preferably at least about 8 mm, and more preferably at least about 10 mm relative to the ground plane 108.

Figure 1N:
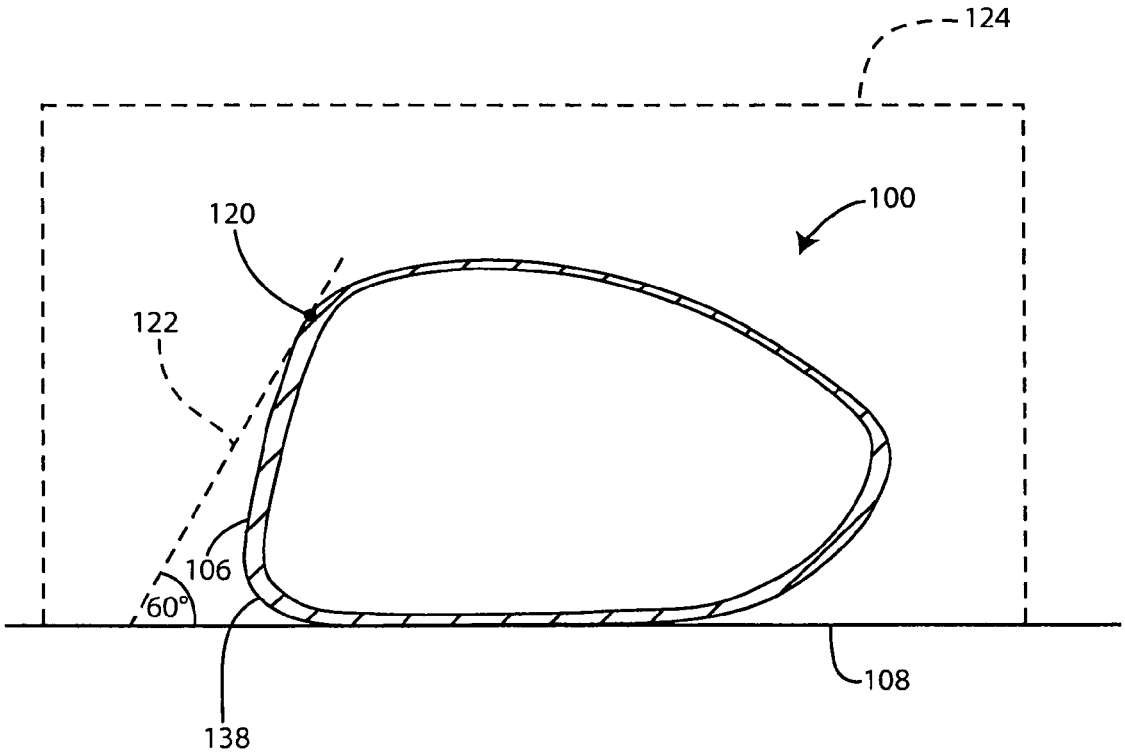
FIG. 1N is a heel-side cross-sectional view of the golf club head of FIG. 1.
Figure 10:
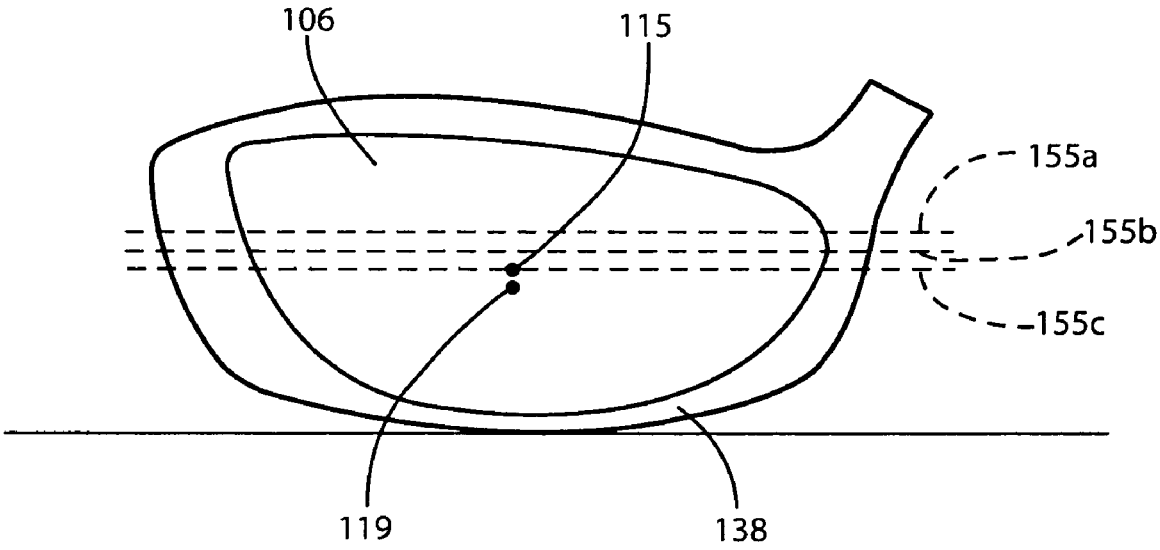

Referring to FIG. 1M and 1N, the strike face 106, according to one or more aspects of the present invention, may have a center anterior apex 120, characterized as the point of tangency between the top of the strike face 106 and an imaginary line 122 (FIG. 1N), oriented at an angle of 60° relative to the ground plane 108 and located in the center plane 124. The center anterior apex 120 may have an elevation 154 of at least about 45 mm, preferably at least about 50 mm, and more preferably at least about 55 mm relative to the center anterior nadir 126*a*.

The strike face 106 may be formed of, e.g., SP700 Beta Titanium—an alpha/beta grade alloy of 4.5-3-2-2 Titanium (Ti-4.5% Al-3% V-2% Mo-2% Fe). Other titanium alloys, including forgings of high-strength titanium alloy, such as 10-2-3 (Ti-10% V-2% Fe-3% Al) or 15-3-3-3 (Ti-15% V-3% Cr-3% Sn-3% Al), may also be utilized. Additionally, castings of 6-4 alloy (Ti-6% Al-4% V), 3-2.5 Titanium (Ti-3% Al-2.5% V), or 15-5-3 Titanium (Ti-15% Mo-5% Zr-3% Al), stainless steel, or the like may also be plausible alternatives.

The incorporation of the lower transition region 138 into the head 100, according to one or more aspects of the present invention, lowers the sweet spot with respect to the strike face 106, compared to a conventional club head, to promote an increase in ball launch angle and carry distance. As shown in FIG. 1O, the sweet spot 119 may preferably be oriented below a first horizontal plane 155*a*, elevated 2 mm above the face center 115. More preferably, the sweet spot 119 may be oriented below a second horizontal plane 155*b*, elevated 1 mm above the face center 115. Most preferably, the sweet spot 119 may be oriented below a third horizontal plane 155*c*, passing through the face center 115. A favorable sweet spot location may be realized when the ratio of the height 150 to the elevation 154 (FIG. 1M) is preferably at least about 0.12, more preferably at least about 0.15, and most preferably at least about 0.20.

Figure 1P:
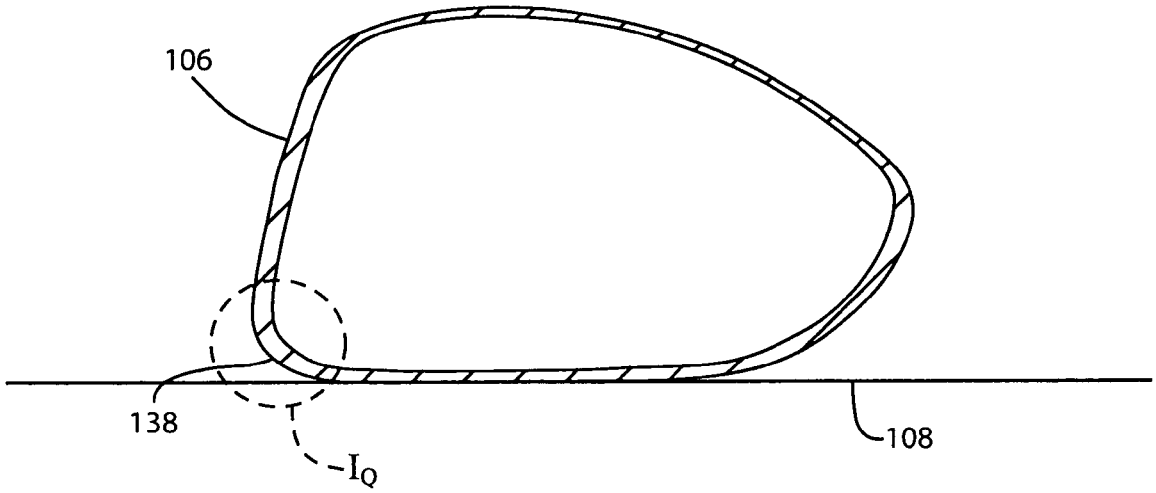
FIG. 1P is a heel-side cross-sectional view of the golf club head of FIG. 1
Figure 1Q:
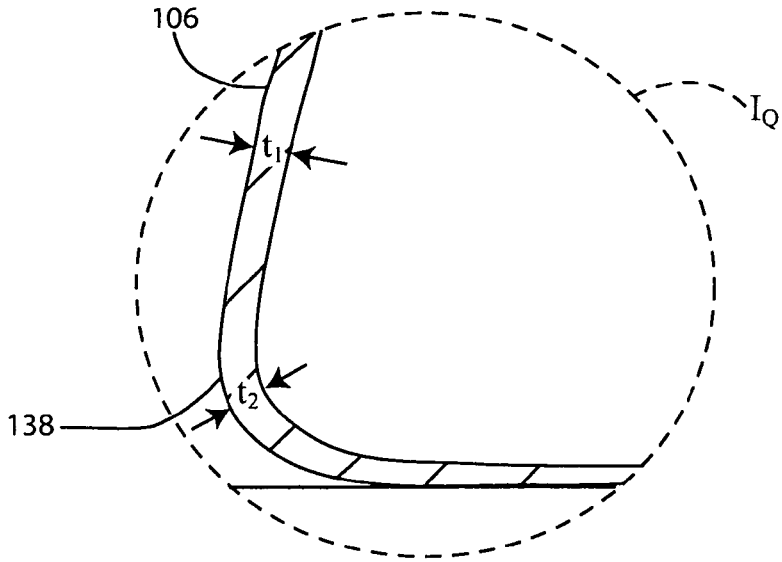
FIG. 1Q is an enlarged cross-sectional view of a detail $I_Q$ of FIG. 1P.

As illustrated in FIGS. 1P and 1Q, an improvement in face compliance and an increase in available discretionary mass may be realized by reducing the thickness of the lower transition region 138 relative to that of the strike face 106, thus augmenting the forgiveness of the head and improving its mass properties. The face thickness may be between about 1 mm and about 5 mm and preferably between about 2 mm and about 4 mm. The thickness of the lower transition region 138 may be between about 0.25 mm and about 3 mm, more preferably between about 0.5 mm and about 2.5 mm, and most preferably between about 1 mm and about 2 mm.

Figure 2:
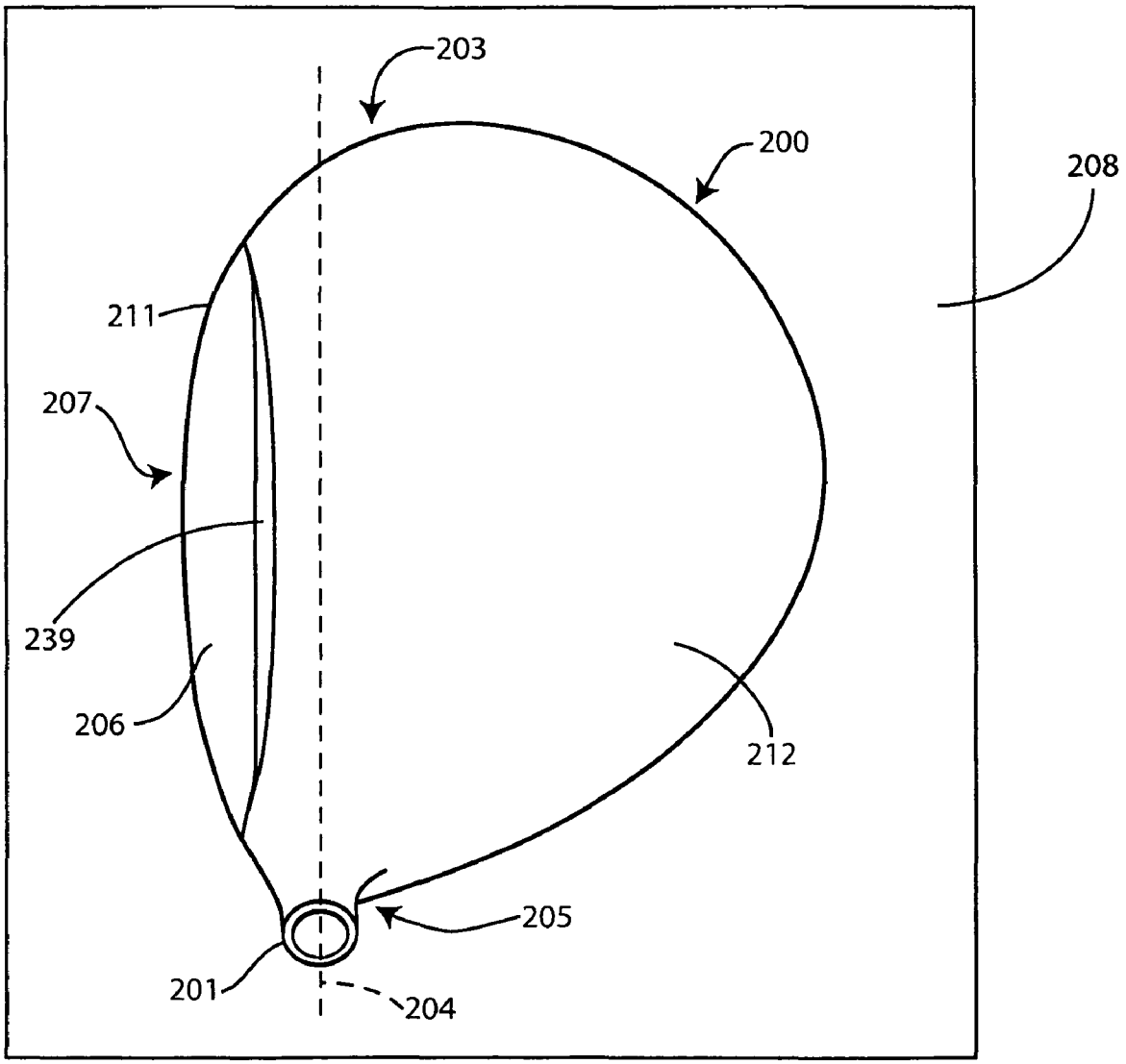
FIG. 2 is a top plan view of an exemplary golf club head according to one or more aspects of the present invention.
Figure 2A:
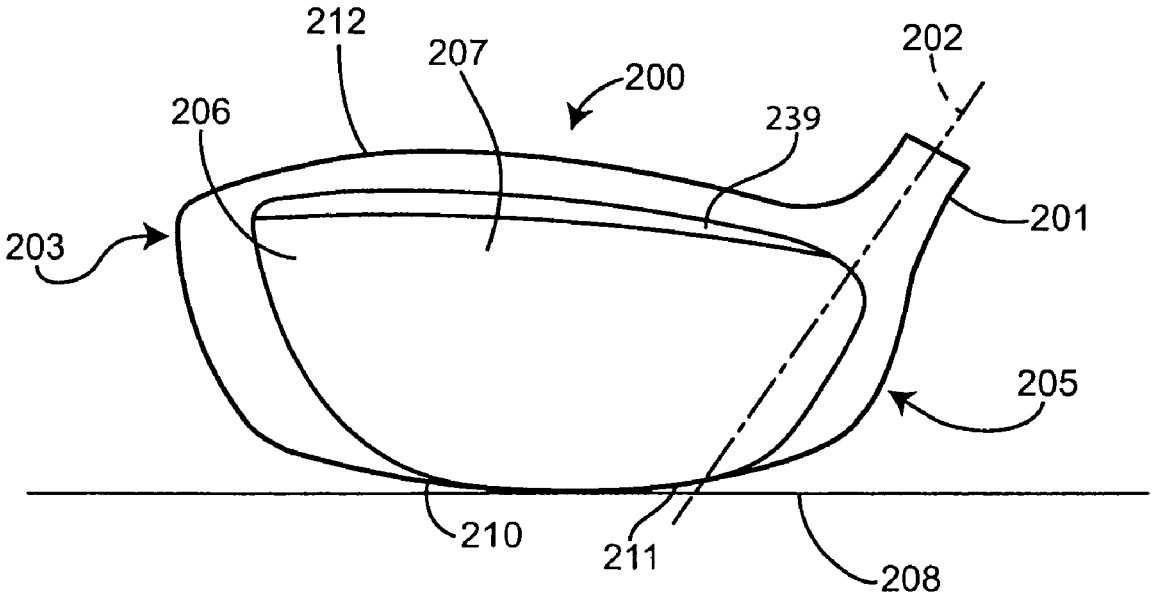
FIG. 2A is a front elevational view of the golf club head of FIG. 2.

As shown in FIGS. 2 and 2A, a club head 200 may comprise a toe 203, a heel 205, a hosel 201, having a central axis (centerline) 202, located in an imaginary vertical hosel plane 204, a sole portion 210, a crown portion 212, and a front surface 207, including a strike face 206. The strike face 206 may have a leading edge 211.

Figure 2B:
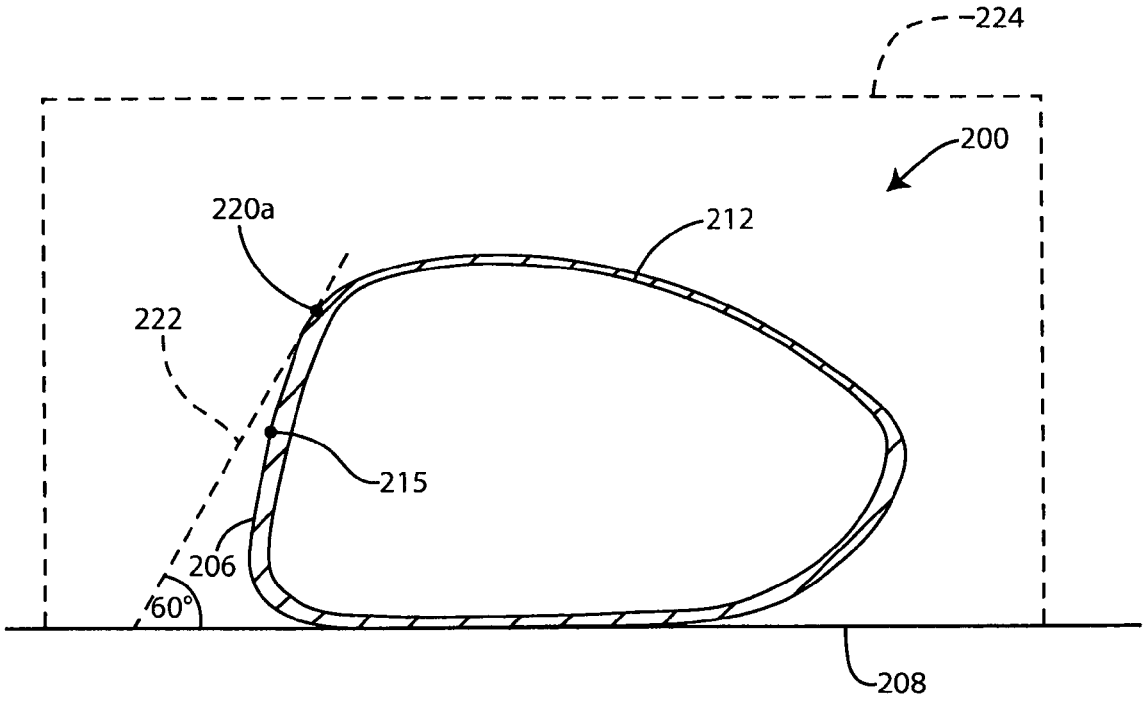
FIG. 2B is a heel-side cross-sectional view of the golf club head of FIG. 2.

Referring to FIG. 2B, the club head 200, according to one or more aspects of the present invention, may further comprise an upper transition region 239 between the strike face 206 and the crown portion 212. The presence of the region 239 increases the average compliance of the strike face 206.

Figure 2C:
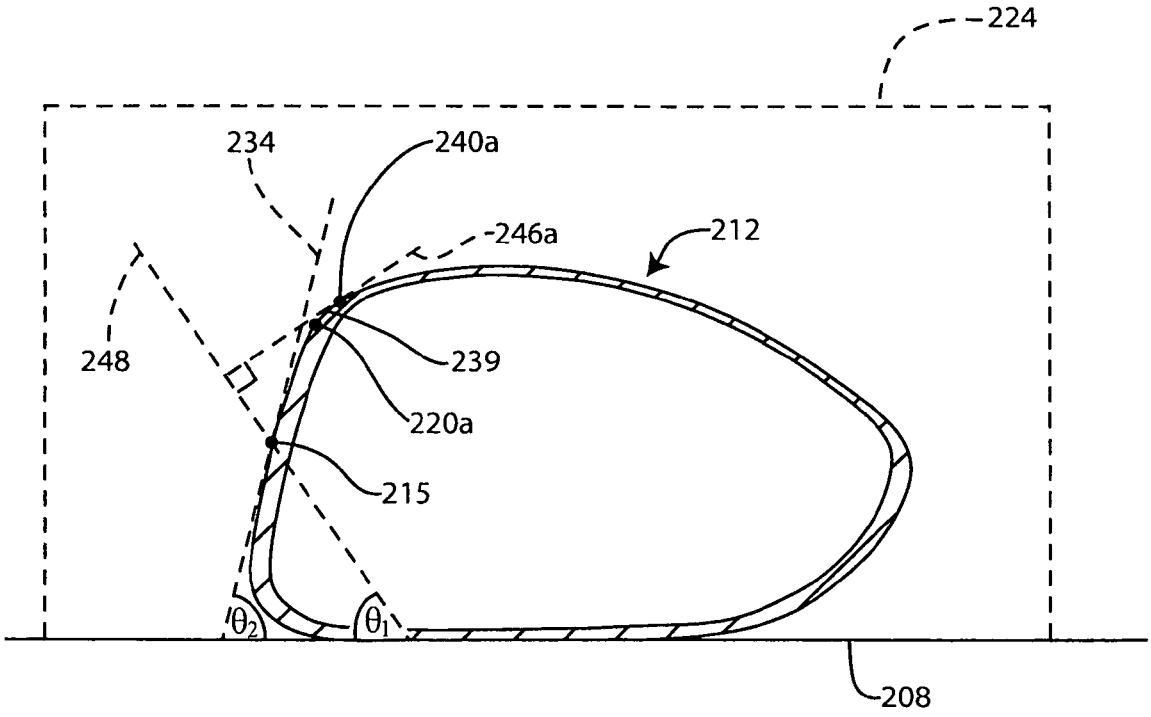
FIG. 2C is a heel-side cross-sectional view of the golf club head of FIG. 2.

Referring to FIGS. 2B and 2C, the club head may further comprise a center anterior apex 220*a*, characterized as the point of tangency between the top of the strike face 206 and an imaginary line 222, oriented at an angle of 60° relative to the ground plane 208 and located in an imaginary vertical center plane 224, substantially perpendicular to the hosel plane 204 (FIG. 2) and passing through a face center 215. The head may also include a center posterior apex 240*a* (FIG. 2C), characterized as the point of tangency between the crown portion 212 of the club head and an imaginary center apex line 246*a*, located in the center plane 224 and perpendicular to an imaginary plane 248 that passes through the face center 215 and forms an acute angle $\theta_1$ with the ground plane 208. The acute angle $\theta_1$ is equal to an acute angle $\theta_2$, formed between the ground plane 208 and a plane 234 that is tangent to the strike face at the face center 215.

Figure 2D:
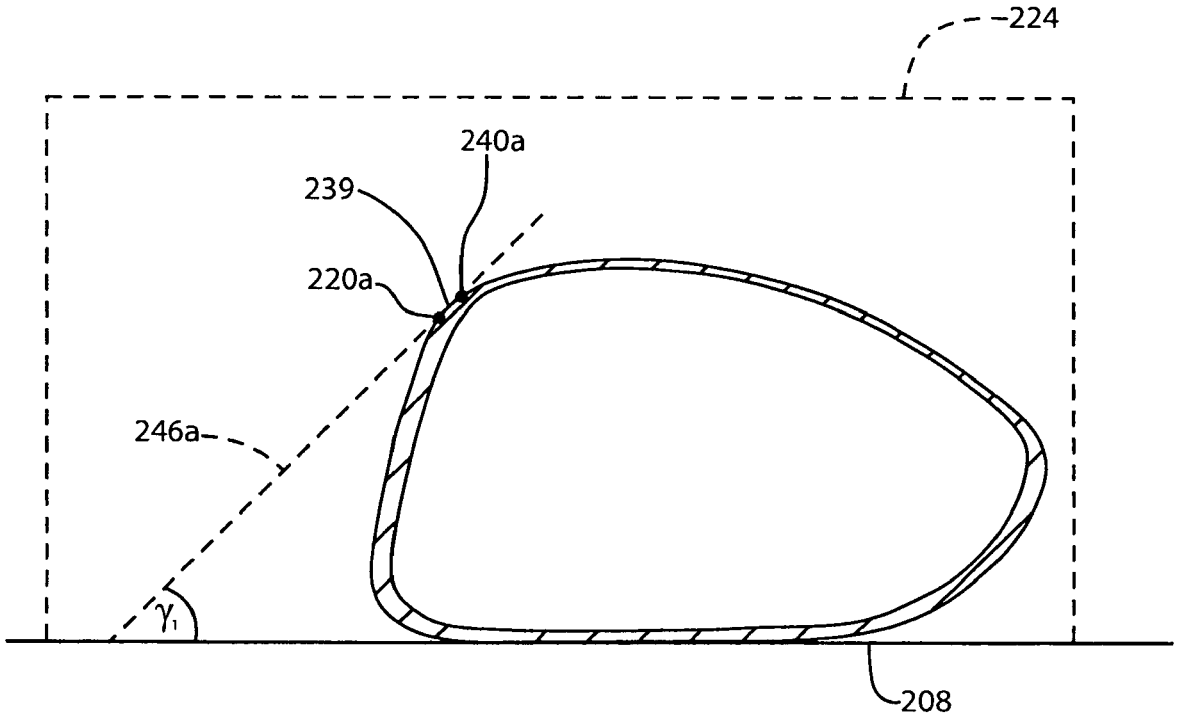
FIG. 2D is a heel-side cross-sectional view of the golf club head of FIG. 2.

Referring to FIG. 2D, a center apex angle $\gamma_1$ may be formed between the ground plane 208 and an imaginary center apex line 246*a*, passing through the center anterior apex 220*a* and the center posterior apex 240*a*. Compliance of the strike face 206 may be modified by increasing or decreasing the center apex angle $\gamma_1$. For example, as the center apex angle $\gamma_1$ increases, the face compliance of the strike face 206 is also increased.

Figure 2E:
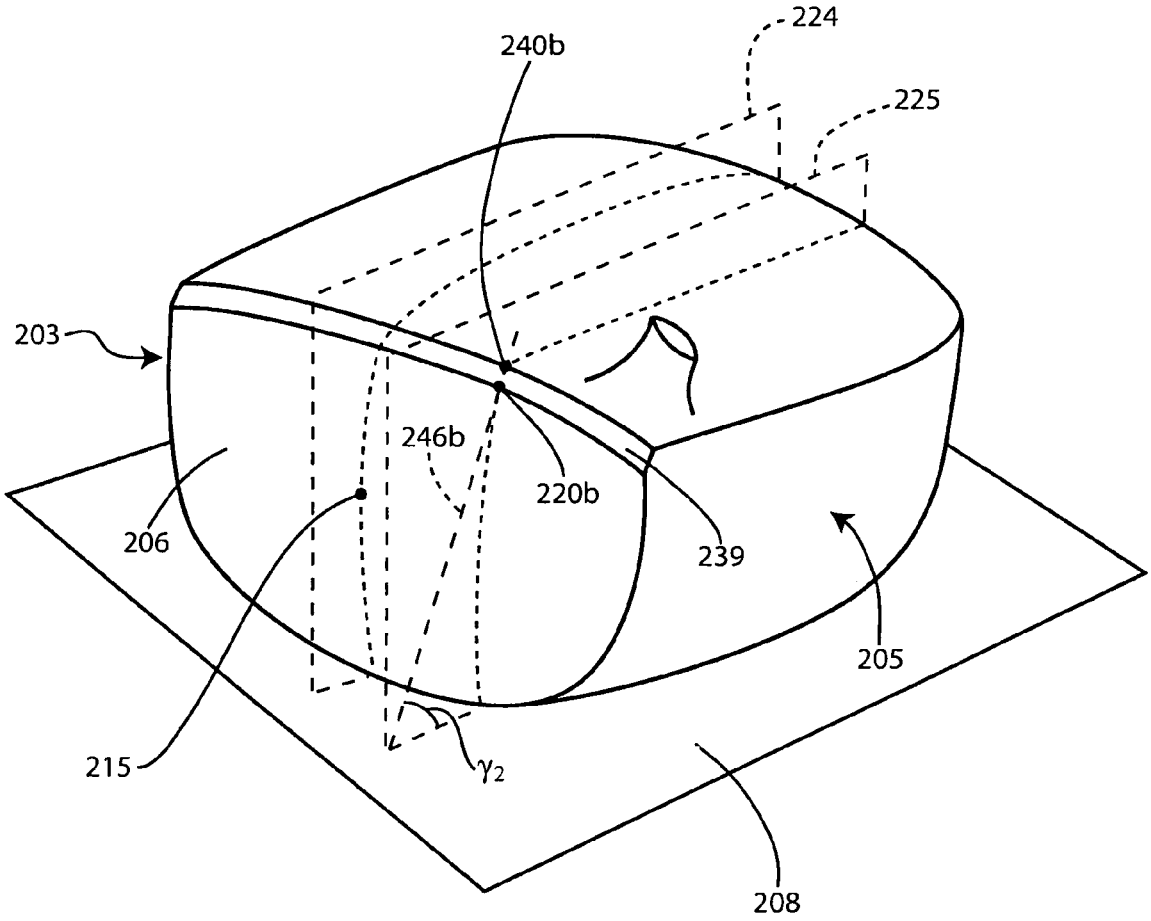
FIG. 2E is a front perspective view of the golf club head of FIG. 2.

As shown in FIG. 2E, offset apex angles, e.g., an offset apex angle $\gamma_2$, are located in corresponding imaginary vertical offset planes, e.g., an offset plane 225, parallel to the center plane 224 and intersecting the club head. Each offset apex angle is formed between the ground plane 208 and an imaginary offset apex lines, e.g., an offset apex line 246*b*, passing through an offset anterior apex, e.g., an offset anterior apex 220*b*, and through a corresponding co-planar offset posterior apex, e.g., an offset posterior apex 240*b*. The offset anterior apexes and the corresponding co-planar offset posterior apexes are identified using the methodologies described above for locating the center anterior and posterior apexes.

The numerical values of the head's apex angles progressively increase from the central region of the strike face to the heel 205 and/or the toe 203. For example, the numerical value of the center apex angle $\gamma$ T (FIG. 2D) may be at least about 5° less than the value of the offset apex angle $\gamma_2$ (FIG. 2F), which is located in the imaginary vertical offset plane 225, spaced a horizontal distance of 20 mm from the center plane 224, parallel thereto. In other examples, the value of the center apex angle $\gamma_1$ may be at least about 8° less than the value of the offset apex angle $\gamma_2$ and preferably at least about 10° less than the value of the offset apex angle $\gamma_2$. The above described head configuration helps maintain the maximum allowable USGA COR limit at the face center, while simultaneously improving face compliance toward the toe and/or the heel of the club head.

Figure 2F:
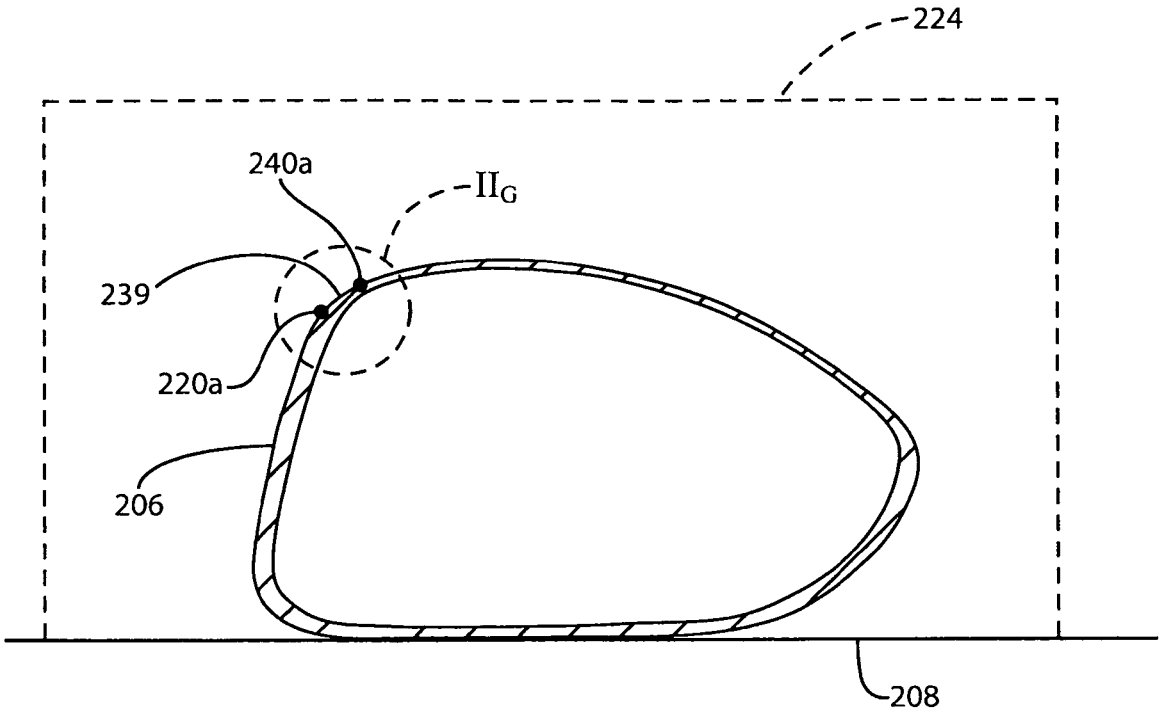
FIG. 2F is a heel-side cross-sectional view of the golf club head of FIG. 2.
Figure 2G:
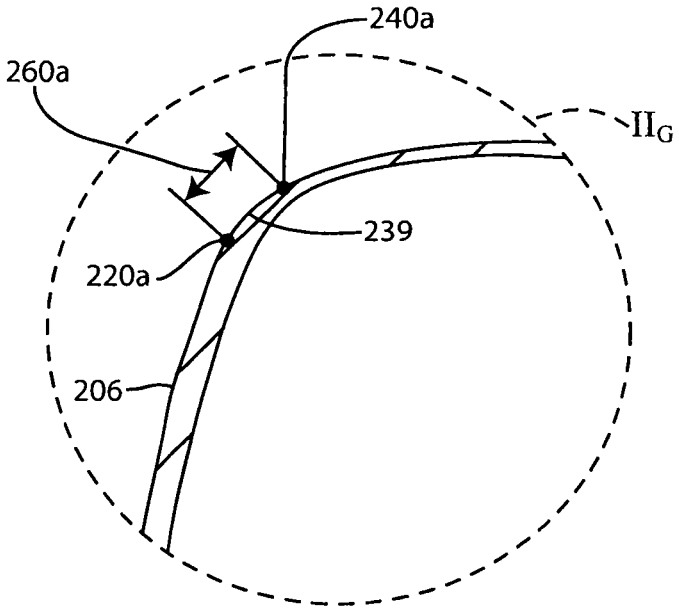
FIG. 2G is an enlarged cross-sectional view of a detail $II_G$ of FIG. 2F.

Referring to FIGS. 2F and 2G, the upper transition region 239 may have an actual center apex distance 260*a* in the center plane 224. The actual center apex distance 260*a* is characterized as the shortest distance between the center anterior apex 220*a* and the center posterior apex 240*a*. The center apex distance 260*a* may be varied to change the compliance of the strike face 206. Preferably, the center apex distance 260*a* may be at least about 8 mm, more preferably at least about 10 mm, and most preferably at least about 12 mm.

Figure 2H:
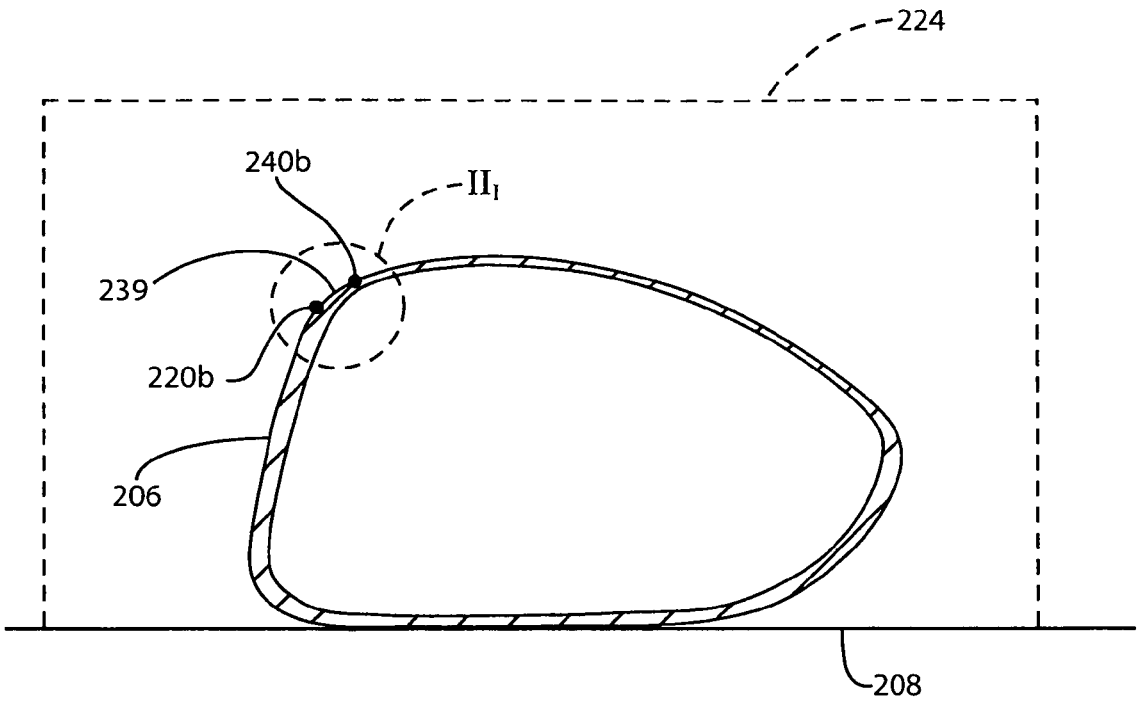
FIG. 2H is a heel-side cross-sectional view of the golf club head of FIG. 2.
Figure 2I:
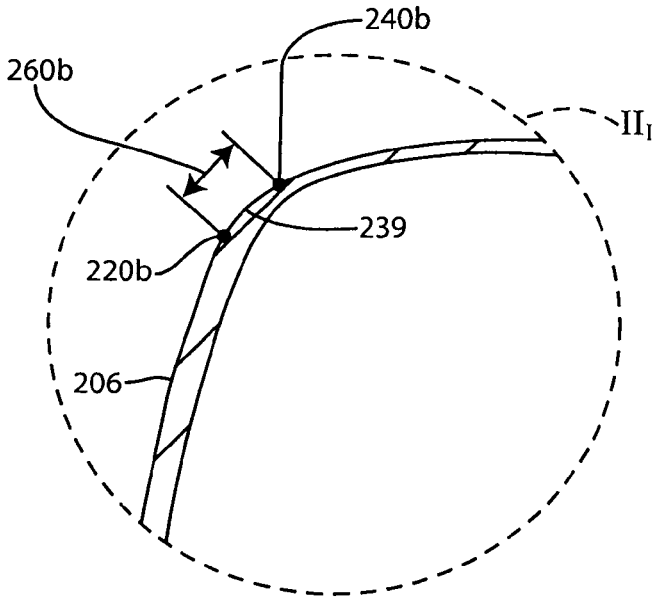
FIG. 2I is an enlarged cross-sectional view of a detail $II_I$ of FIG. 2H.

Referring to FIGS. 2H and 2I, an actual offset apex distance 260*b* is characterized as the shortest distance between the offset anterior apex and the corresponding co-planar offset posterior apex. Preferably, the offset apex distance is greater than the center apex distance 260*a* (FIG. 2G) to help improve the compliance of the strike face away from the face center. For example, the offset apex distance 260*b* may be greater than the center apex distance 260*a* by at least about 2 mm. Preferably, the offset apex distance 260*b* may be at least about 8 mm, more preferably at least about 10 mm, and most preferably at least about 12 mm.

Figure 2J:
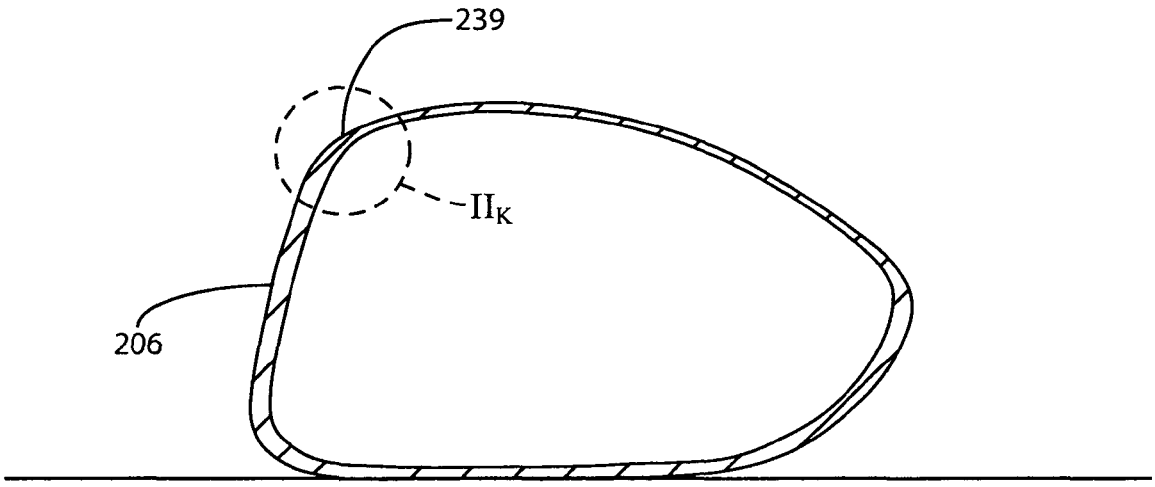
FIG. 2J is a heel-side cross-sectional view of the golf club head of FIG. 2.
Figure 2K:
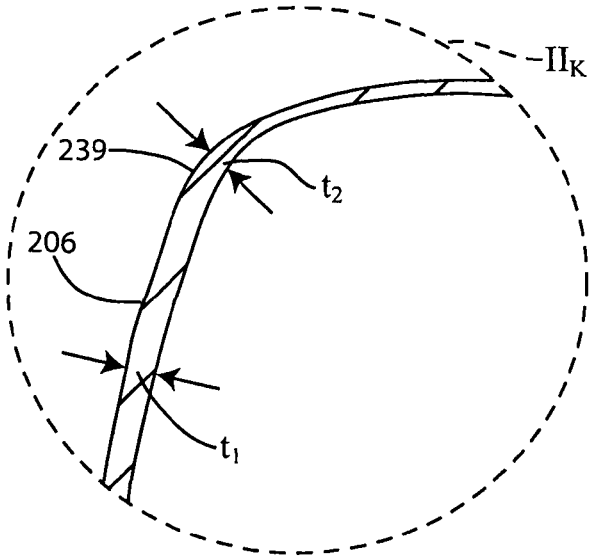
FIG. 2K is an enlarged cross-sectional view of a detail $II_K$ of FIG. 2J.

As illustrated in FIGS. 2J and 2K, an improvement in face compliance and an increase in the club head's available discretionary mass may be realized by reducing the thickness of the upper transition region 239 of the strike face 206. The face thickness may be between about 1 mm and about 5 mm and preferably between about 2 mm and about 4 mm. The thickness of the upper transition region 239 may be between about 0.25 mm and about 3 mm, more preferably between about 0.5 mm and about 2.5 mm, and most preferably between about 1 mm and about 2 mm.

Figure 3:
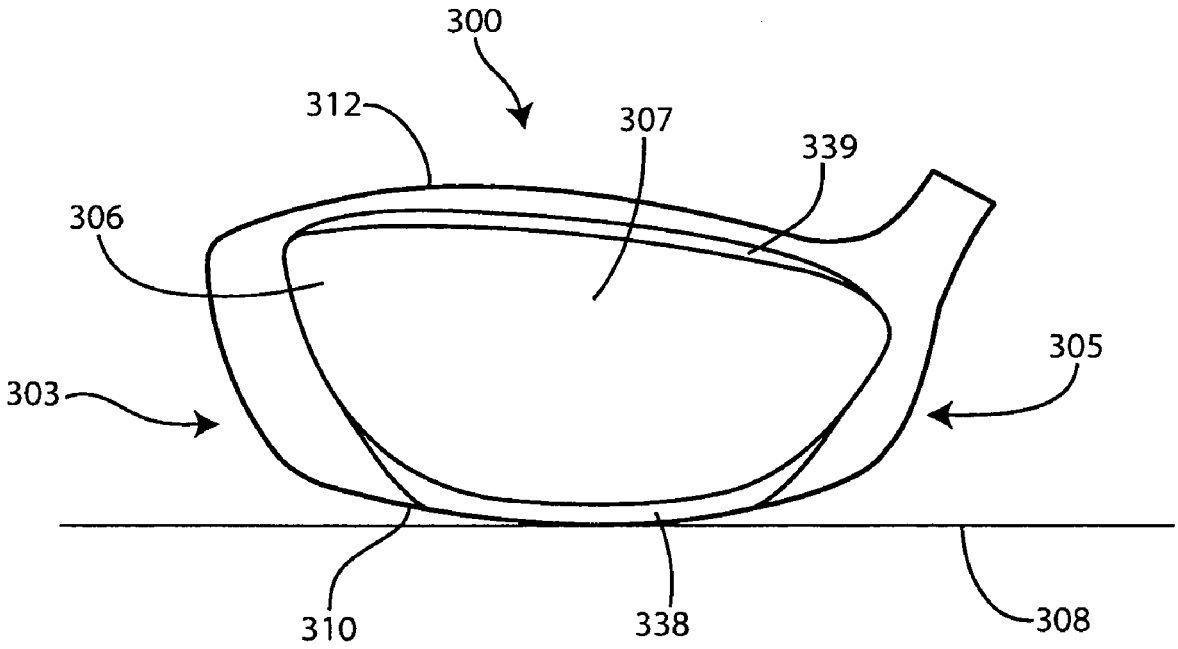
FIG. 3 is a front elevational view of an exemplary golf club head according to one or more aspects of the present invention.

Referring to FIG. 3, a club head 300, according to one or more aspects of the present invention, may comprise a toe 303, a heel 305, a sole portion 310, a crown portion 312, and a front surface 307, including a strike face 306. The club head 300 may further include a lower transition region 338 and an upper transition region 339 to increase the compliance of the strike face 306 and improve the mass properties of the club head.

The club head 300 may be formed from a wide variety of materials, including metals, polymers, ceramics, composites, and wood. For instance, the club head 300 may be made from stainless steel, titanium, or graphite fiber-reinforced epoxy, as well as persimmon or laminated maple. In one example, the club head may be formed, at least in part, of fiber-reinforced or fiberglass-reinforced plastic (FRP), otherwise known as reinforced thermoset plastic (RTP), reinforced thermoset resin (RTR), and glass-reinforced plastic (GRP).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A golf club head oriented in a reference position relative to a ground plane, the golf club head comprising:

a strike face including a face center;

a hosel including a hosel axis;

an imaginary vertical hosel plane containing the hosel axis;

an imaginary vertical center plane perpendicular to the imaginary vertical hosel plane and passing through the face center;

a center anterior nadir located in the imaginary vertical center plane, the center anterior nadir having a height relative to the ground plane; and a center anterior apex located in the imaginary vertical center plane, the center anterior apex having an elevation relative to the center anterior nadir, the ratio of the height of the center anterior nadir to the elevation of the center anterior apex being at least about 0.12.

2. The golf club head of claim 1, wherein the ratio of the height of the center anterior nadir to the elevation of the center anterior apex is at least about 0.15.

3. The golf club head of claim 2, wherein the ratio of the height of the center anterior nadir to the elevation of the center anterior apex is at least about 0.20.

4. The golf club head of claim 1, wherein the height of the center anterior nadir is at least about 6 mm.

5. The golf club head of claim 4, wherein the height of the center anterior nadir is at least about 8 mm.

6. The golf club head of claim 5, wherein the height of the center anterior nadir is at least about 10 mm.

7. The golf club head of claim 1, wherein the elevation of the center anterior apex is at least about 45 mm.

8. The golf club head of claim 7, wherein the elevation of the center anterior apex is at least about 50 mm.

9. The golf club head of claim 8, wherein the elevation of the center anterior apex is at least about 55 mm.

* * * * *